United States Patent [19]

Johne et al.

[11] 4,368,668

[45] Jan. 18, 1983

[54] PRINTING PLATE MOUNTING ARRANGEMENT

[75] Inventors: Hans Johne, Radebeul; Arndt Jentzsch, Coswig; Günter Schumann, Radebeul; Arnfried Jehring, Coswig; Fritz Liebschner, Weinböhla; Rolf Gutsche, Coswig; Frank Grafe, Radebeul, all of German Democratic Rep.

[73] Assignee: Veb Kombinat Polygraph "Werner Lamberz" Leipzig, Leipzig, German Democratic Rep.

[21] Appl. No.: 264,667

[22] Filed: May 15, 1981

[51] Int. Cl.[3] ..... B41F 27/00

[52] U.S. Cl. ..... 101/212; 101/DIG. 12; 101/415.1

[58] Field of Search ..... 101/212, 216, DIG. 12, 101/415.1; 33/184.5

[56] References Cited

U.S. PATENT DOCUMENTS

| | | | |
|---|---|---|---|
| 1,458,477 | 6/1923 | Gamble et al. | 101/415.1 |
| 1,478,947 | 12/1923 | Gamble et al. | 101/415.1 |
| 2,245,617 | 6/1941 | Stafford et al. | 101/216 |
| 3,789,757 | 2/1974 | Motter et al. | 101/216 X |

FOREIGN PATENT DOCUMENTS

| | | | |
|---|---|---|---|
| 223756 | 10/1924 | United Kingdom | 101/415.1 |

*Primary Examiner*—Clifford D. Crowder
*Attorney, Agent, or Firm*—Michael J. Striker

[57] ABSTRACT

An arrangement for facilitating the mounting of printing plates on a plate cylinder of an offset printing machine. Two arms are mounted atop the machine at the opposite lateral sides thereof and have free ends provided with hooks. A rail is suspended from these hooks and carries quick-coupling devices which engage the trailing edge of a printing plate to be mounted. The hooks are suspended on ropes which are wound upon rollers mounted on the free ends of the arms; turning of the rollers in a sense causing unwinding of the ropes is resisted by torque springs or similar devices; this resistance can be varied to compensate for printing plates of different weights. Thus, the weight of the printing plate cannot cause the ropes to unwind; however, when the leading edge of the printing plate is connected to the plate cylinder and the cylinder is slowly rotated to take the plate up on it, the pull exerted by the cylinder causes unwinding of the ropes.

6 Claims, 3 Drawing Figures

PRINTING PLATE MOUNTING ARRANGEMENT

BACKGROUND OF THE INVENTION

This invention relates to a printing plate mounting arrangement.

More particularly, the invention relates to an arrangement for facilitating the mounting of printing plates on the plate cylinder of an offset printing machine.

In offset printing machines the matter to be printed is contained on a printing plate which is mounted on, and rotates with, the plate cylinder of the machine. Therefore, whenever the matter to be printed is to be changed, the old printing plate must be removed and replaced by another one containing the new matter to be printed. Removal of the old plate presents no problem, because no particular care and certainly no precision is required. However, this is different when the new plate is being installed, since the plate must be so positioned that it is properly located on the plate cylinder; otherwise, mis-prints will result.

This requires a series of carefully executed operations on the part of the operator (or even several operators where large printing plates are to be handled). For example, the operator must hold the plate in exactly the right position during insertion of one of its edge portions into the retaining slot of the plate-cylinder plate-clamping rail. Care must be taken to assure properly precise positioning of the plate relative to the various abutments which are provided. Once the edge portion of the plate is properly and securely clamped, the printing machine is then operated in "creep" mode so that the slowly turning plate cylinder winds the plate up about its circumference.

A problem with this is that the printing plate can easily be damaged during such handling. If the damage is serious enough to be noted at once, the printing plate will have to be scrapped before printing even begins. If the damage is not so immediately noticeable (e.g. to the print face), the situation is even more annoying because as a rule some printing will have been done before the damage is discovered and the entire printing run up to discovery will then have to be discarded along with the printing plate. Moreover, the prior art manner of installing a new printing plate is physically demanding of the operator and is also rather slow, which latter factor is reflected in comparatively long machine down time.

SUMMARY OF THE INVENTION

It is a general object of the invention to overcome the prior-art disadvantages.

A more particular object is to provide an arrangement which serves for mounting of printing plate, i.e. acts in aid of such mounting.

Still another object is to provide such an arrangement as mentioned hereinabove, which will speed up mounting of the printing plate and consequently reduce machine down time.

A concomitant object is to provide an arrangement of the type under discussion, which will reduce or eliminate physical demands upon the operator in connection with printing plate installation.

An additional object is to provide such an arrangement which assures precise positioning of the printing plate in preparation for securing of the same to the plate cylinder.

Pursuant to the above objects, and still others which will become apparent hereafter, one aspect of the invention resides in an arrangement for mounting printing plates on the plate cylinder of an offset machine printing station, comprising at least two arms mountable at opposite lateral sides of a printing station and each having a free end portion; engaging means for engaging a trailing edge portion of a printing plate to be installed on a plate cylinder of the printing station; releasable holding means releasably connectable with the engaging means; and connecting means for yieldably connecting the holding means to the free end portions of the arms.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
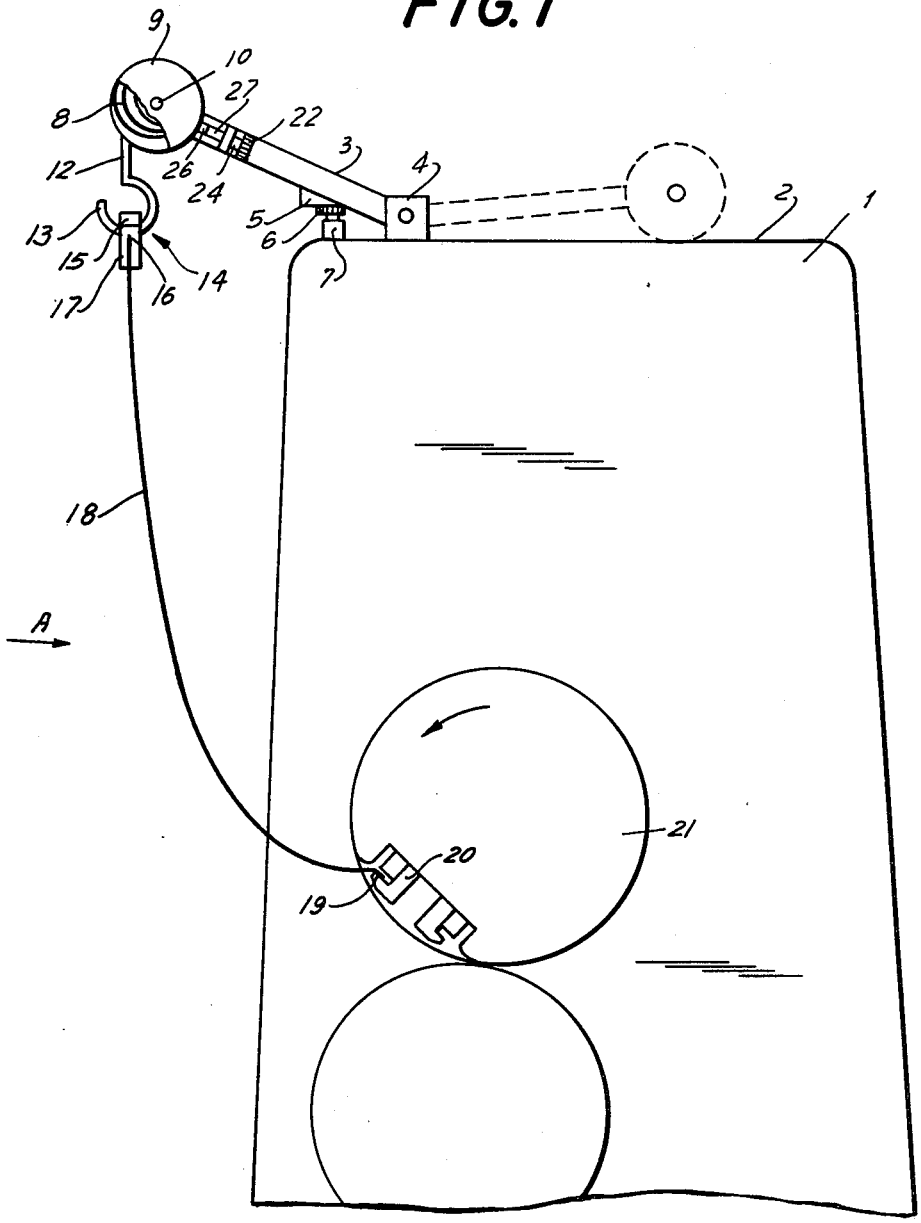
FIG. 1 is a somewhat diagrammatic side view of a printing station provided with the invention.
Figure 2:
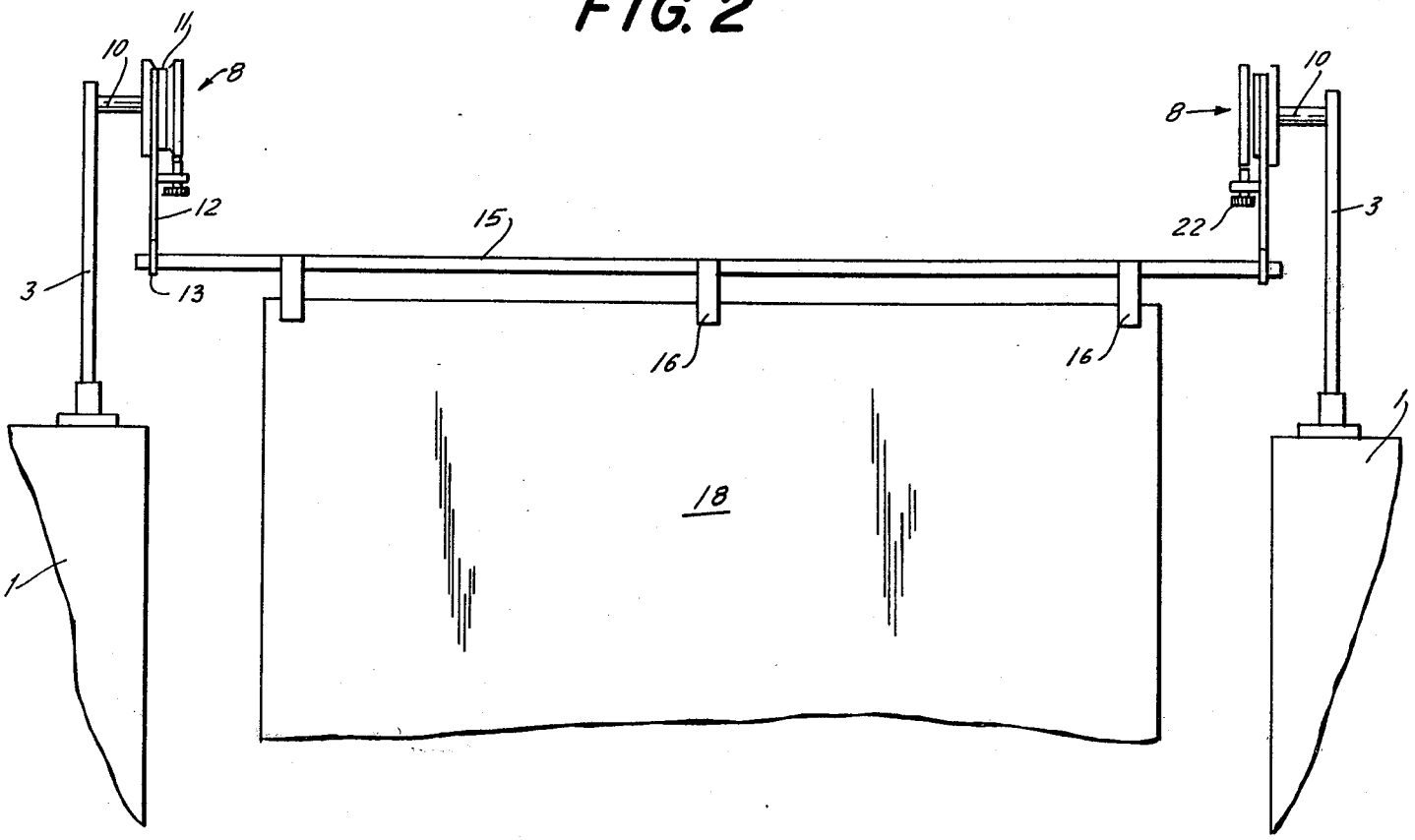
FIG. 2 is a front view of FIG. 1, as seen in the direction of arrow A.

An embodiment of the inventive arrangement is illustrated in FIGS. 1 and 2 in the context of a printing station 1 of an offset printing machine. No specific details will be given of the printing station 1, since such stations are known per se and, in any case, do not form a part of the present invention except insofar as the inventive arrangement is mounted on the printing station. However, it is noted that in the conventional manner the station 1 has a plate cylinder 21 which is provided with a plate-clamping rail 20 for clampingly engaging the leading edge 19 (as considered in the direction of rotation of plate cylinder 21) of a printing plate 18 which, in operative condition, is trained about and supported on the circumferential surface of the cylinder 21.

The inventive arrangement for facilitating the installation of such printing plates 18 on the cylinder 21 has a pair of arms 3 which are mounted atop the station 1 at the opposite lateral sides thereof. Mounting brackets 4 are fixedly secured to the top of station 1 and the arms 3 are pivoted in them so that they can be displaced between the operative (full-line) position and an inoperative (dashed-line) position.

Also mounted on the top of the station 1 are bosses 7 in which bolts 6 are turnably engaged so that they can be raised and lowered by threading them in or out. That side of each arm 3 which in the operative position faces downwardly, is provided with a consoele or similar abutment 5 which is so positioned as to rest on the head of the respective bolt 6. Thus, the angular position of arms 3 can be changed (i.e. the arms can be raised or lowered) depending upon the extent to which the bolts 6 are threaded into or out of the bosses 7.

The free end of each arm 3 carries a printing-plate suspending element, in the illustrated embodiment configurated as a torque spring 8. Each spring 8 is accommodated in a split housing 9 the two halves of which are threaded together. Each arm 3 also carries a shaft 10 which extends into the respective housing 9 and on which the spring 8 is mounted. A roller 11 is seated on shaft 10 and rigidly connected with one of the halves of housing 9. A rope 12 or similar element has one end connected to the roller 11 about which it is trained; it is maintained in wound-up condition on the roller 11 by the torque exerted by spring 8.

The free end of each rope 12 carries a hook 13 or analogous engaging element and a plate-holding device 14 is hung from these hooks 13. The holding device 14 comprises a rail 15 which extends from one to the other of the hooks 13 (see FIG. 2) and on which plate-engaging elements 16 are mounted. These are constructed as quick-engagement/quick-release devices which will be discussed in more detail with reference to FIG. 3 and which engage the trailing edge portion 17 of the printing plate 18.

Different printing plates have different weights. Since it is intended for the spring 8 to hold the trailing edge 17 of each printing plate in the position shown in FIG. 1 (until take-up of the plate begins onto the cylinder 21) irrespective of the plate weight, the force opposed by the device 8, 9 to the pull of the respective printing plate 18 must be adjustable. For this purpose each arm 3 is provided with an internal (as shown) or external mount 24 through a tapped bore of which a bolt 22 is threaded. A pin 27 is guided in the respective arm 3 for movement lengthwise thereof and carries adjacent the turnable part of the housing 9 a layer or pad 26 of friction-promoting material (i.e. a brake pad or the like). Bolt 22 and pin 27 are coupled via a spring (not shown) so that requisite turning of bolt 22 causes the pad 26 to be pressed with greater or lesser force against housing 9 to compensate for different-weight printing plates.

Figure 3:
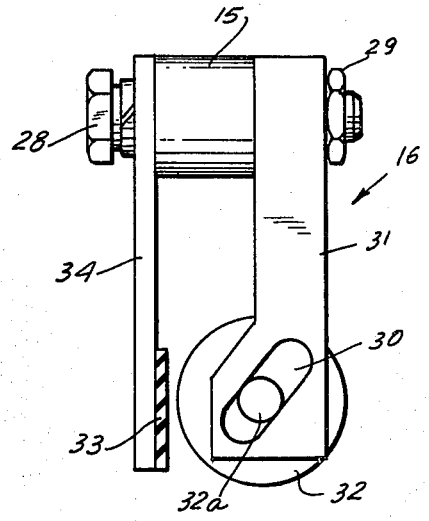
FIG. 3 is a side view of an element of the arrangement shown in FIGS. 1 and 2, illustrated on an enlarged scale.

The quick-couplings 16, of which any desired number may be arranged over the length of rail 15, are secured to the rail by means of bolts 28 and nuts 29. One of them is shown in FIG. 3. Each of these couplings 16 has two arms 31 (one shown) depending from the rail 15 and spaced from one another. These arms 31 are provided with upwardly inclined registering slots 30 and a roller 32 is located between the arms 31 and has trunnions **32*a* at its opposite axial ends which are received in the respective slots 30. An abutment plate 34 is spaced from the arms 31 and extends over the axial length of roller 32; it carries at its lower portion a strip or layer 33 of friction-promoting material (.e.g. similar to a brake pad). The roller 32** itself is of elastically yieldable (e.g. elastomeric) material.

To connect printing plate 18 to these couplings 16 it is merely necessary to insert its edge portion 17 upwardly from below into the gap between roller 32 and layer 33. This causes roller 32 to move up along the slots 30 but to remain—due to its weight—in firm contact with the facing surface of the edge portion 17. Any subsequent downward movement of the edge portion 17 causes the same to become firmly wedged between roller 32 and layer 33 and to be held thereby. When it is desired to release the edge portion, it is merely necessary to lift the roller 32 slightly upwardly in its slots 30.

To use the arrangement according to the invention the arms 3 are pivoted to the solid-line operating position. The holding device 14 is detached and connected via the couplings 16 to the trailing edge 17 of a printing plate 18 to be mounted on the plate cylinder 21. Now the holding device 14 is hooked back onto the hooks 13 which are located at such a height relative to plate cylinder 21 (via adjustment of the arms 3 by bolts 6) that when the leading edge portion 19 of printing plate 18 is inserted into the clamping rail 20, the plate 18 will be bowed as shown in FIG. 1. This assures that the front edge of the leading edge portion 19 will properly engage the rail 20. After the rail 20 is operated to clamp the edge portion 19 in place, the printing station is operated in creep gear, causing the plate cylinder 21 to turn very slowly in the direction indicated by the arrow. This exerts sufficient pull upon the ropes 12 via the plate 18, to overcome the force of spring 8 (and any additional retarding force offered by the pad 26), so that the ropes 12 are slowly unwound from the rollers 11 and guide the trailing edge 17 as the printing plate is convoluted about the plate cylinder 21. When the plate 18 is fully located on cylinder 21 the device 14 is disengaged from the trailing edge portion 17.

Since the plate 18 is firmly held in position at all times, the possibility of damage to the plate is almost totally precluded. Physical exertion of the operator is limited to the effort required to suspend the plate and the device 14 from the hooks 13. Proper positioning of the plate 18 for engagement by rail 20 is rapid and exact and the overall time required to install a new printing plate is substantially reduced.

While the invention has been illustrated and described as embodied in a printing plate mounting arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Arrangement for mounting printing plates on the plate cylinder of an offset machine printing station, comprising at least two arms mountable at opposite lateral sides of a printing station and each having a free end portion; engaging means for engaging a trailing edge portion of a printing plate to be installed on a plate cylinder of the printing station, said engaging means comprising a rail, and a plurality of plate-engaging devices mounted on said rail; releasable holding means releasably connectable with said engaging means; and connecting means for yieldably connecting said holding means to said free end portions of said arms, said plate-engaging devices each including support means depending from said rail, abutment means spaced from and opposite said support means and provided with a friction-promoting layer, slots in said support means inclined downwardly and in direction towards said abutment means and the layer, and an elastically yieldable roller shiftable in said slots towards and away from said layer.

2. Arrangement as defined in claim 1, said holding means comprising open hooks, and said connecting means comprising rollers and ropes connected to said hooks and wound onto the respective rollers, and resilient means yieldably resisting turning of said rollers in a sense resulting in unwinding of said ropes.

3. Arrangement as defined in claim 2, said resilient means being torque springs.

4. Arrangement as defined in claim 2; and further comprising means for varying the yieldable resistance of said resilient means.

5. Arrangement as defined in claim 1; and further comprising means for mounting said arms on the printing station so as to be pivotable between an operating position and a rest position.

6. Arrangement as defined in claim 1; and further comprising means for height-adjusting said free end portions of said arms relative to the printing station.

* * * * *